US008161921B2

(12) United States Patent
Marchetti

(10) Patent No.: US 8,161,921 B2
(45) Date of Patent: Apr. 24, 2012

(54) METHOD TO CONVERT FREE-PISTON LINEAR MOTION TO ROTARY MOTION

(76) Inventor: George A. Marchetti, Western Springs, IL (US)

( * ) Notice: Subject to any disclaimer, the term of this patent is extended or adjusted under 35 U.S.C. 154(b) by 676 days.

(21) Appl. No.: 12/370,749

(22) Filed: Feb. 13, 2009

(65) Prior Publication Data

US 2009/0199821 A1 Aug. 13, 2009

Related U.S. Application Data

(60) Provisional application No. 61/028,451, filed on Feb. 13, 2008.

(51) Int. Cl.
*F02B 71/00* (2006.01)

(52) U.S. Cl. ..... 123/46 R; 123/46 E

(58) Field of Classification Search ..... 123/46 R–46 H
See application file for complete search history.

(56) References Cited

U.S. PATENT DOCUMENTS 2,949,101 A * 8/1960 Brann ..... 123/46 R

* cited by examiner

*Primary Examiner* — Noah Kamen
(74) *Attorney, Agent, or Firm* — Schwegman, Lundberg & Woessner, P.A.

(57) ABSTRACT

Embodiments described herein include a method for converting free-piston linear motion to rotary motion, comprising:

providing a free-piston generator or motor/generator that has at least one piston having two compression heads; and, for each piston, a surface is provided on each compression head defining a helical channel, wherein the piston is rotated in a single direction due to the force imparted to the piston as compressed air in an air box is forced through the helical channel.

6 Claims, 3 Drawing Sheets

METHOD TO CONVERT FREE-PISTON LINEAR MOTION TO ROTARY MOTION

RELATED APPLICATION

This application claims the benefit of U.S. Provisional Application Ser. No. 61/028,451 filed Feb. 13, 2008, which is incorporated herein by reference.

FIELD

Inventive subject matter described herein refers to method embodiments for converting free-piston linear motion to rotary motion.

BACKGROUND

The free-piston linear engine is a twentieth century invention that eliminates the need for piston rods and a crankshaft, which are traditionally associated with internal combustion piston engines. Within a free-piston engine, power may be provided to a load by devices other than a crankshaft, e.g., hydraulically or by an exhaust gas turbine. The engine is referred to as a "free" piston engine because the piston travels freely back and forth within the combustion cylinder(s). Free-piston engines have been used as air compressors, hydraulic power devices, and as linear motor/generators.

One of the advantages of free-piston engines is that they may employ higher compression ratios than the compression ratios typically associated with crankshaft engines. Because of this characteristic, free-piston engines may efficiently utilize a wide spectrum of different ignition regimes and fuels. Free-piston engines have been built, or have been proposed, to operate with spark ignition, diesel ignition, and homogeneous charge compression ignition for example. The free-piston engine's high compression ratio capability, coupled with the flexibility to utilize different ignition regimes, suggests that this engine may revolutionize 21$^{st}$ century combustion engine technology.

Recently, the work of Dr. Peter Van Blarigan at Sandia National Laboratories has demonstrated that a free-piston engine can effectively operate with homogeneous charge compression ignition (HCCI). See, U.S. Pat. No. 6,199,519. An HCCI engine represents an important advance in the state of the art because it allows combustion efficiency to approach ideal Otto cycle efficiency. HCCI is an extremely high compression ratio ignition regime. Fuel and air are pre-mixed in the combustion cylinder (unlike the diesel cycle where the air is first heated by compression and the fuel is then injected in a droplet form). During compression of the fuel/air charge, the temperature in the cylinder reaches, or exceeds, the auto-ignition temperature of the selected fuel in air. Consequently, the fuel/air charge spontaneously ignites when the appropriate compression ratio and temperature is attained in the cylinder. Extremely lean fuel/air mixtures are possible with HCCI. The free-piston engine's unique ability to achieve extremely high compression ratios makes it an ideal engine for HCCI operation.

The Van Blarigan free-piston engine is a two-stroke, linear motor/generator. It has dual combustion chambers, one on either side of the moveable free-piston. The exterior surface of the piston contains magnets, although in some embodiments the piston may serve as a platform for a shutter, as discussed below. After the HCCI combustion event in the first combustion chamber, the piston is propelled toward the second combustion chamber. The movement of the magnets, located on the piston's surface, induces on electrical current in coils located in a stator that surrounds the piston. The free-piston provides the necessary force to compress the fuel/air charge in the second combustion chamber to its autoignition temperature. The combusted gases in the first combustion chamber are scavenged, by means of an external device (e.g., a turbocharger), during this stroke and a fresh charge of fuel and air is introduced. After ignition in the second combustion chamber, the piston travels back toward the first chamber to compress and ignite the fresh fuel/air charge. An electric current is again generated as the magnets on the piston's surface traverse the surrounding coils. The combusted gases from the second combustion chamber are scavenged and a fresh fuel/air charge is introduced into that chamber. The two-stroke cycle then repeats. Van Blarigan reports high combustion efficiencies with HCCI combustion. For example, with natural gas as the fuel, Van Blarigan has found that thermal efficiencies of over 50% can be achieved, which approaches ideal Otto cycle efficiency.

In U.S. Pat. No. 6,541,875, Berlinger has disclosed a free-piston linear motor/generator in which the magnetic armature and coils are physically separated from the combustion chamber. Physical separation of the magnets and coils is possible because the Berlinger engine employs a single combustion chamber, rather than the dual combustion chamber of the Van Blarigan engine. This physical separation of the magnets and the coils from the single combustion chamber reduces the likelihood that the magnets and/or coils will become overheated during engine operation. The Berlinger engine also relies on the linear motion of the piston to generate electrical power.

In the Wechner dual combustion chamber linear motor/generator, liquid cooling is employed in an area adjacent to the coils and the fresh intake air is drawn through the main body of the piston in order to provide a degree of air-cooling to the magnets located circumferentially on the exterior of the piston. See, U.S. Pat. No. 6,651,599. The Wechner motor/generator's piston is substantially hollow in order to allow for the delivery of compressed air for scavenging. Like the Van Blarigan and Berlinger devices, the Wechner engine locates the magnets on the surface of the piston, which adds to piston weight and reduces linear piston velocity.

Because the voltage produced by a free piston generator is proportional to the speed of the piston, it is advantageous to minimize the piston weight as much as possible in motor/generator designs which solely rely upon linear motion. Removal of the magnets from the piston main body and positioning the magnets on the stator allows a significant reduction in piston weight. Southwest Research Institute (SWRI) has modeled a single chamber free-piston motor/generator in which the magnets and coils are located on the stator. The SWRI model is cited by Van Blarigan as an alternate free-piston linear motor/generator configuration. SWRI has identified two configurations in which high electrical efficiency may be achieved with linear piston motion and with the magnets and coils mounted on the stator of the engine. The first design is a two-coil linear inductance generator. The magnets generate a magnetic field around the armature windings. The piston has a sleeve, which, as the piston moves from top dead center (TDC) to bottom dead center (BDC), acts as a shutter to collapse the magnetic field. As the shutter crosses the magnetic field, the field collapses and a current is induced in the armature. As the piston returns to TDC from BDC, the magnetic field is restored. SWRI reports that the two-coil inductance generator may be 90% electrically efficient. In a second design, a direct current may be generated as the shutter moves through a magnetic field produced by a ferromagnetic yoke and field windings. A sliding contact is required by this configuration. SWRI estimates that this design may also be 90% electrically efficient. Unfortunately, the relatively large air gap associated with shutters limits the actual electrical power that can be derived from this model. Also, because the SWRI model is a single chamber design, the piston is returned to TDC by means of a bounce cylinder, which is less efficient than the dual chamber configuration. The SWRI model is further based on spark ignition, rather than high compression diesel ignition or HCCI.

The SWRI inventors note that there are several significant operating deficiencies associated with free-piston linear generators that mount the magnets on the piston. Among those concerns are exposure of the magnets to high temperatures, high vibration levels or both. In addition, the weight of permanent magnets directly affect the operational speed of the reciprocating free-piston. The operational speed of the piston is critically dependent on piston weight. Because the induced voltage of the free-piston generator is proportional to piston velocity, by mounting heavy permanent magnets on the piston, the linear velocity of the piston will be reduced and the voltage-producing capability of the engine will be adversely impacted.

The art of free-piston technology further discloses that, unlike the above-cited devices, in which the piston's motion is limited to linear motion, a free-piston engine can operate as a rotary engine. This approach is typified by the General Motors free-piston gas turbine engine developed in the 1950's. The General Motors engine utilized the exhaust gas from two free-piston engines in order to turn a gas turbine, which was the primary load. The exhaust gas effectively converted the linear motion of the free-piston engine into rotary motion. However, delivery of exhaust gas through a receiver lowered the overall system efficiency. Moreover, the usable exhaust gas pressure from the free-piston engines was limited by the temperatures that could be tolerated by the blades of the gas turbine.

In principle, however, an effective method to convert the free-piston's linear motion to rotary motion can address the velocity (and voltage) limitations imposed by piston weight on modern, state-of-the-art free-piston generators. The velocity of a rotary piston is not constrained by linear, reciprocating motion limitations and the weight of the load on the piston may assume less importance due to inertial forces.

The patent literature discloses several other devices that have been previously employed to convert the linear motion of a free-piston into rotary motion. For example, Hinds, in U.S. Pat. No. 4,295,381, discloses a free-piston engine with a gyroscopic power transmission. In U.S. Pat. No. 5,850,111, Haaland discloses a push-pull bearing, which allows the free-piston to rotate. In U.S. Pat. No. 6,244,226, Berlinger has disclosed a means for causing a free-piston to rotate. The torque for effecting the free-piston rotation is derived from a plurality of vanes, which cause the piston to rotate upon the piston's movement toward its top dead center position.

DETAILED DRAWINGS

DETAILED DESCRIPTION

Figure 1:
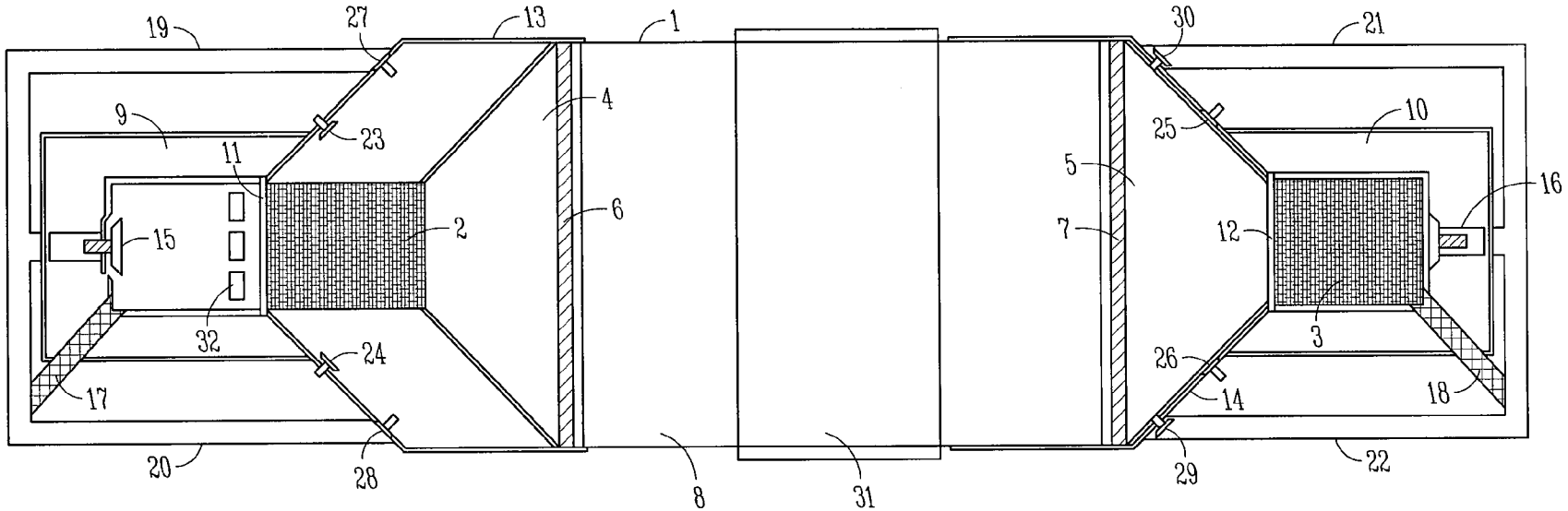
FIG. 1 illustrates a side view of one embodiment of a free-piston generator.

Although detailed embodiments of the invention are disclosed herein, it is to be understood that the disclosed embodiments are merely exemplary of the invention that may be embodied in various and alternative forms. Specific structural and functional details disclosed herein are not to be interpreted as limiting, but merely as a basis for teaching one skilled in the art to variously convert free-piston linear motion to rotary motion embodiments.

Referred to herein are trade names for materials and components. The inventor herein does not intend to be limited by materials described and referenced by a certain trade name. Equivalent materials (e.g., those obtained from a different source under a different name or catalog (reference) number to those referenced by trade name may be substituted and utilized in the methods described and claimed herein. All percentages and ratios are calculated by weight unless otherwise indicated. All percentages are calculated based on the total composition unless otherwise indicated.

Applicant has found that it would be a beneficial advance if a method for the operation of a free-piston generator or motor/generator could be devised, which would convert the linear motion of the piston directly into rotary motion, without the necessity of an intermediary exhaust receiver, gas turbine, push-pull bearings or vanes. For example, by employing such a method with a free-piston generator or motor/generator, the velocity of the magnets relative to the coils could be substantially increased because the rotary motion could be preserved by angular momentum. Thus, some of the limitations imposed on piston velocity, and electric power, by virtue of the repeated back and forth redirection of the linear, reciprocating motion of the free-piston would be minimized by preserving angular piston momentum in a rotary fashion. However, the significant advantages of the free-piston engine, including its multi-fuel and multi-ignition regime characteristics, would be retained.

Embodiments are described herein to convert a portion of the linear motion of a free-piston generator or motor/generator into rotary motion in an aerodynamic fashion without the necessity of a receiver, gas turbine, push-pull bearing or vanes.

According to the embodiments of the present method, the linear motion of a free-piston can be converted into rotary motion by employing air boxes, compression heads and helical rifling or channels (a "helical channel") on the surface of the compression heads.

The free-piston is movable back and forth between two combustion chambers. In order to convert the linear motion of the free-piston to rotary motion, a system is provided to impart torque to the piston. Helical channels are used for some embodiments, although in a manner that is substantially different from other applications, such as certain weaponry applications.

Unlike a rifled bullet, the free-piston in an engine is not simply discharged from a barrel. Its motion is a more complex, reciprocating motion. Thus, the helical channels on either side of the piston are devised so that the rotation of the piston occurs in one direction only (e.g., clockwise). By maintaining the rotation of the piston in one direction, the angular momentum of the rotating piston is preserved as more energy is added to the system by successive combustion events. Maintaining angular momentum allows the velocity of the rotating piston to increase in relationship to the engine's stator, which is advantageous for free-piston generators and motor/generators as discussed above.

The method embodiments described herein include a helical channel located on a surface of each compression head, which head preferably has a conical surface, although other shapes may be employed. An air box in the free-piston engine serves to intake fresh air for combustion purposes and to compress the fresh air during the engine's two-stroke cycle. In this method embodiment, the compression head further serves to convert the free-piston's linear motion into rotary motion. The walls of the helical channel are oriented parallel to the axis of piston rotation. When the compression head is drawing in fresh air, a partial vacuum in the air box is created. Because there is minimal air pressure against the surface of the compression head during air intake, little or no rotational force is applied to that surface. However, in an opposing air box, the fresh air that was previously drawn into that air box is compressed. Compression increases the air pressure against the helical channel on the surface of the second compression head causing it to rotate in the selected direction. Torque is applied to the compression head by virtue of the boundary layer drag of the air as it is forced through the helix. The boundary layer is the thin layer of air molecules adhering to the channel surface. As the second compression head moves back from its maximum compression location, due to the motion of the free-piston as discussed below, a partial vacuum is created in that air box and fresh air is drawn into the second air box. During fresh air intake in the second airbox, little or no rotational force is applied to the second head. However, compression is now occurring in the first air box. Compression increases the air pressure against the helical channel on the surface of the compression head, causing it to rotate in the selected direction.

Thus, method embodiments provide that rotary motion can be imparted to a free-piston by means of a helically channeled surface on each compression head. Because the rotational forces on each compression head alternate and because the helical channels are devised for unidirectional rotation, the method embodiments permit the rotation of the free-piston to occur in one direction. Unidirectional rotation of the free-piston enables the piston velocity relative to the stator to exceed the linear motion velocity as compared to the stator of the free-piston engines of the prior art. Moreover, no receiver, separate gas turbine, push-pull bearing or vanes are required in method embodiments in order to convert the free-piston's linear motion into rotary motion. The use of helically channeled, solid compression heads, as taught by this method, simplifies the manufacturing process and results in a more robust structure than is possible under conventional methods. One embodiment can be understood with reference to FIG. 1, which represents one possible application of the method.

EXAMPLE 1

FIG. 1 is one exemplary embodiment of a free-piston generator employing the present method. The free-piston main body 1 (hereinafter referred to as the "piston") is generally comprised of (1) two combustion pistons 2, 3 with compression heads 4, 5; (2) two piston rings 6, 7; and (3) the mounting piston section 8, which serves to connect the combustion pistons 2, 3 in order to form a single piston assembly, of which the compression heads 4, 5 are integral components. For the purposes of this example, the compression heads 4, 5 are truncated, solid cones and each combustion piston 2, 3 is a solid cylinder.

Figure 2:
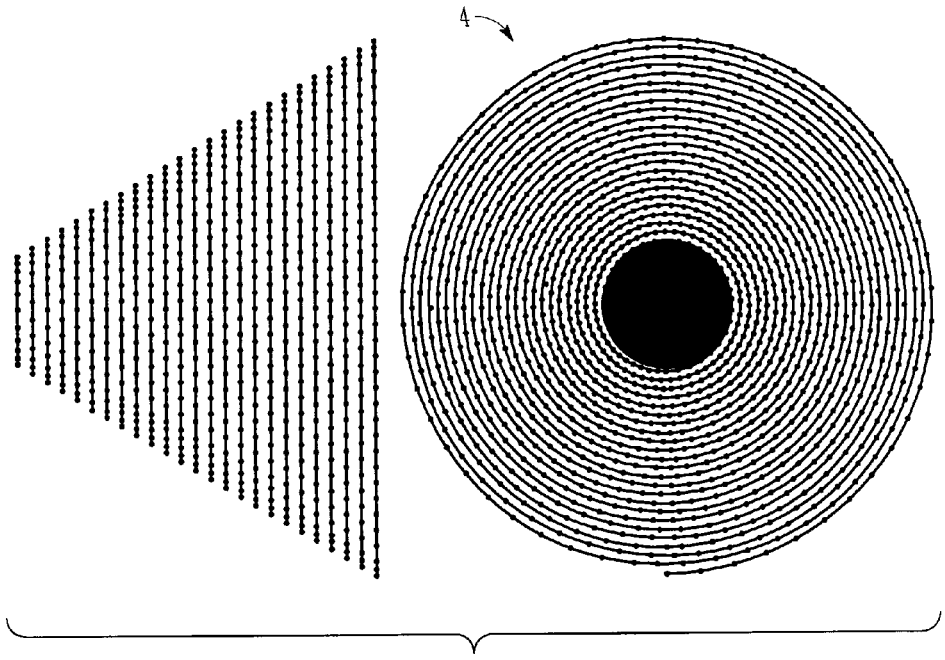
FIG. 2 illustrates a side view and a front view of one embodiment of a free-piston compression head with a helical channel provided on its surface.

The compression head 4, 5 is part of the combustion piston 2, 3 structure and may be comprised of the same material as the combustion piston 2, 3. The compression head 4, 5 serves to distribute the force of each combustion event over the solid volume of the mounting piston section 8. The compression head 4, 5 further serves as an air intake and compression device in order to provide compressed air for scavenging and combustion purposes. The compression head 4, 5 further serves to impart torque to the free-piston 1 by means of a helical channel, an example of which is shown in FIG. 2, provided on the surface of each compression head 4, 5. There is at least one piston ring 6, 7 located at, or near, the base of each compression head 4, 5 adjacent to the mounting piston section 8.

In this method embodiment, the combustion pistons 2, 3 and the compression heads 4, 5 include silicon nitride. The choice of silicon nitride allows the combustion pistons 2, 3 to be operated in an oilless condition. See, e.g., Wade, et al. U.S. Pat. No. 4,846,051. For completely oilless lubrication, the piston rings 6, 7 and bearings 11,12 may be coated with a solid lubricant, as known to those skilled in the art, such as titanium nitride or certain high temperature thin film carbon coatings. Because silicon nitride is a poor thermal conductor, the use of this material in the context of the method embodiments reduce the quantity of heat from the combustion events that will be absorbed by the mounting piston section 8. Further, it is assumed that the mounting piston section 8 itself is comprised of a rigid material that is a poor thermal conductor, such as 316L stainless steel. The mounting piston section 8 serves as a platform, depending on the selected electrical embodiment, for the magnets, coils or shutters. The interior of the mounting piston section 8 is substantially hollow. The conical shape of the compression heads 4, 5 serves to direct the force of each combustion event to the rigid portion of the mounting piston section 8. The posterior portions of the compression heads 4, 5 are joined to the mounting piston section 8 by such devices as are known to those skilled in the art in order to form the free-piston 1 assembly. Such methods may include cast-in molding of the mounting piston section 8 to the compression heads 4, 5 among other conventional methods.

As will be noted, the combustion pistons 2, 3 have no piston rings. Concentricity of the combustion pistons 2, 3 is maintained in the combustion cylinders 9, 10 by bearings 11, 12, which may be roller bearings for example. The combustion cylinders 9, 10 and air boxes 13, 14 also include silicon nitride or other compatible ceramic material. The engine further includes compressed air intake valves 15, 16; fuel injectors 17,18; compressed air headers 19, 20, 21, 22; air intake valves 23, 24, 25, 26; and compressed air outlet valves 27, 28, 29, 30. The valves may be poppet valves, or other types of valves, that suitably open and close during engine operation. The timing of fuel injection by the fuel injectors 17, 18 may be controlled by the electronic control center and a piston position sensor (not shown). The load 31, in this example, includes one or more magnets.

For the purposes of this example, the ignition regime is assumed to be diesel ignition. The engine is started by conventional mechanisms. Engine operation is as follows. Fresh air is introduced into the left air box 13 as the compression head 4 moves to the right, increasing the air box 13 volume and opening the fresh air intake valves 23, 24 due to the pressure differential between atmospheric pressure and the partial vacuum pressure in the air box 13. Simultaneously, fresh air in the right air box 14 is compressed as its compression head 5 moves to the right. As the air in the right air box 14 is compressed, the air intake valves 25, 26 are closed due to the higher pressure in the air box 14. In addition, the compression of the air in the air box 14 causes the compression head 5 to rotate in the selected direction due to the helical channel on the surface of that compression head 5, as hereinabove described. As the pressure increases in the air box 14, the compressed air outlet valves 29, 30 open and compressed air from the air box 14 is delivered to the compressed air headers 21, 22. The compression head 5 continues to rotate as the compression of air through the valves 29, 30 applies torque to the compression head 5 via the helical channel. The compressed fresh air in the compressed air headers 21, 22 is initially restrained by the closed intake valve 16. At or about the time that the right exhaust port (not shown) is uncovered by the combustion piston 3 due to the ignition of the injected fuel from the fuel injector 18 in the compressed air in the combustion cylinder 10, the pressure drop in the combustion cylinder 10 causes the intake valve 16 to open and fresh, compressed air scavenges the combustion cylinder 10. Scavenging continues until about the time that the combustion piston 3 again covers the exhaust port during the next stroke.

When the left combustion piston 2 is at or about BDC, the right combustion piston 3 is at or about TDC. The piston 1 then moves to the left by virtue of the ignition of the fuel/air charge in the right combustion cylinder 10. As the combustion piston 2 moves to the left and traverses the left exhaust port 32, the compressed air intake valve 15 closes. The exhaust port 32 is covered by the combustion piston 2 and the air remaining in the combustion cylinder 9 after scavenging is compressed. The fresh air that had been introduced into the left air box 13 undergoes compression as the compression head 4 moves to the left.

As the air in the left air box 13 is compressed, the air intake valves 23, 24 are closed due to the higher pressure in the air box 13. In addition, the compression of the air in the air box 13 causes the compression head 4 to rotate in the selected direction due to the helical channel on the surface of that compression head 4, as hereinabove described. As the pressure increases in the air box 13, the compressed air outlet valves 27, 28 open and compressed air from the air box 13 is delivered to the compressed air headers 19, 20. The compression head 4 continues to rotate as the compression of air through the valves 27, 28 applies torque to the compression head4 via the helical channel. The compressed fresh air in the compressed air headers 19, 20 is initially restrained by the closed intake valve 15. Fuel is injected into the left combustion cylinder 9 by the fuel injector 17. The combustion pressure in the combustion chamber 9 forces the piston 1, which includes the combustion pistons 2, 3, the compression heads 4, 5, and the mounting piston section 8 to the right. At or about the time that the left exhaust port 32 is uncovered by the combustion piston 2 due to the ignition of the injected fuel from the fuel injector 17 in the compressed air in the combustion cylinder 9, the pressure drop in the combustion cylinder 9 causes the intake valve 15 to open and fresh, compressed air scavenges the combustion cylinder 9. Scavenging continues until about the time that the compression piston 2 covers the exhaust port 32 during the next stroke. The cycle then repeats.

The load 31 and the piston 1 undergo both linear and rotational motion in accordance with the teachings of this method. The linear motion of the piston 1, as described above, is converted to rotational motion by virtue of the helical channels provided on the surfaces of the compression heads 4, 5. During compression in the air box 13 or 14, the appropriate helical channel causes the compression head 4 or 5 to rotate in the selected direction. During air intake in the air box 13 or 14, little or no force is applied via the helical channel. In this manner, each of the helical channels in the surface of the opposed compression heads 4 or 5 alternately experiences a force during air compression, which causes the piston 1 to rotate continuously in the selected direction (i.e., clockwise or counter-clockwise).

EXAMPLE 2

Figure 3:
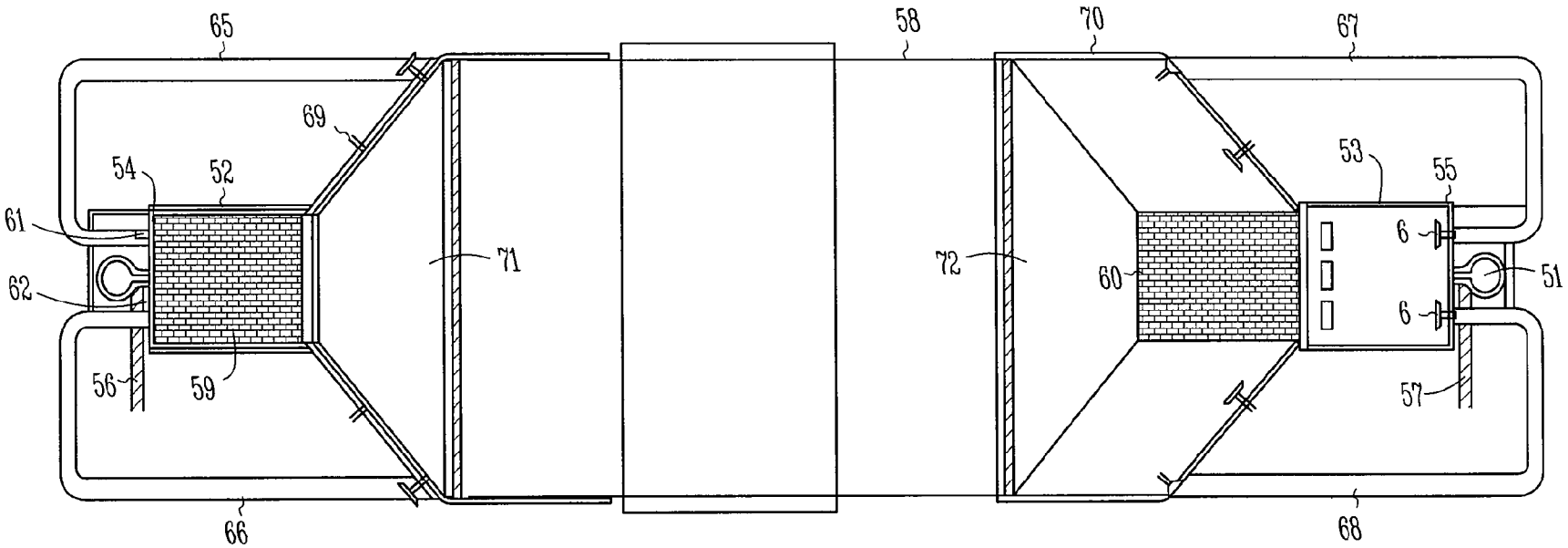
FIG. 3 illustrates a side view of another embodiment of a free-piston generator in which there are a mixing/combustion chamber and an expansion chamber.

In another exemplary embodiment of the present method, which is illustrated in FIG. 3, the rotary, free-piston motor/generator operates in the Otto cycle. The fuel, which may be a liquid or gaseous fuel, is injected into a separate "mixing/combustion chamber" wherein the injected fuel is mixed with the air during the compression stroke, which is hereinafter referred to as "stratified charge" combustion. The term "Otto cycle", as used herein, refers to an engine cycle in which fuel and air are mixed prior to the ignition event and includes stratified spark ignition and stratified charge compression ignition (SCCI) regimes.

In accordance with this particular stratified charge combustion example, the free-piston motor/generator's combustion chamber is divided into two different operating regions or sections. The first section is referred to herein as the "mixing/combustion chamber"50,51. The second section is referred to as the "expansion chamber"52,53. The mixing/combustion chamber50,51 may be spherical as shown in FIG. 3. An electronically-controlled, solenoid slide valve, or other appropriate valve (generically referred to herein as a "slide valve") 54,55, separates the mixing/combustion chamber50,51 from the expansion chamber52,53. The valve54,55 is closed at or near the conclusion of the power, or expansion, stroke of the free-piston motor/generator. The valve54,55 remains closed during scavenging and until the combustion piston closes the exhaust port. During the time that the slide valve54,55 is closed, fuel is injected into the mixing/combustion chamber50,51 by means of a suitable fuel injector56,57. The mixing/combustion chamber50,51 is filled with cooled, oxygen-depleted exhaust from the prior combustion event, which had occurred previously in the chamber. Consequently, when the fuel is injected, combustion cannot occur immediately. As the piston58 moves toward top dead center and closes the exhaust port, the slide valve54,55 opens. The air in the expansion chamber52,53 is compressed through the open valve54,55, through the throat of the mixing/combustion chamber50,51 and into the mixing/combustion chamber50,51. The compressed air then mixes in a swirling fashion with the fuel, and remaining gases from the prior combustion event, in the mixing/combustion chamber50,51.

With an Otto cycle, spark ignition regime, at or about the time that the piston58 reaches top dead center in the expansion chamber52,53, the spark plug (not shown) ignites the swirled fuel/air mixture in the mixing/combustion chamber50,51. The flame rapidly expands through the fuel/air mixture, causing the pressure to rise in the mixing/combustion chamber50,51 and in the adjacent expansion chamber52,53. With an Otto cycle, SCCI ignition regime, the high temperatures associated with compression cause the swirled fuel/air mixture in the mixing/combustion chamber50,51 to ignite.

After the Otto cycle ignition event (either spark ignition or SCCI), the pressure rise of the combusted gases in the mixing/combustion chamber50,51 is directed through the throat of the chamber against the head of the combustion piston59,60 and causes the piston58 to move toward bottom dead center. At or about the time that the combustion piston59,60 uncovers the exhaust port toward the end of the power stroke, the slide valve54,55 closes and the intake valves61,62 or 63,64 open. The intake valves61,62 or 63,64 open due to the pressure differential between the compressed air in the compressed air headers65,66 or 67,68 and atmospheric pressure. The expansion chamber52,53 is then scavenged by the fresh, compressed air. Fuel is again injected into the exhaust remaining in the closed mixing/combustion chamber50,51. The two-stroke cycle then repeats.

As the piston58 is driven in a reciprocating fashion by the Otto cycle combustion events occurring in each of the opposed chambers of the free-piston motor/generator, air in the air boxes69,70 is compressed through the helix on the conical surface of each compression head71,72, as previously described. The drag of the air through the helical channel causes the piston58 to rotate. In this manner, for the purposes of this example, the rotary free-piston motor/generator can operate in the Otto cycle either with a liquid fuel or with a gaseous fuel.

The use of a stratified fuel/air charge, in the context of the present method for operation of a rotary, free-piston motor/generator, may also serve to address two issues that are commonly associated with HCCI combustion. In the HCCI engine, a homogeneous, or near homogeneous, fuel/air mixture is compressed so that auto-ignition occurs when the piston is near the top dead center position. A high compression ratio is necessary to assure auto-ignition. Normally, very lean fuel/air mixtures must be used in order to achieve the slow chemistry that reduces the combustion rate and peak pressures. The rapid HCCI combustion rate associated with near-stoichiometric fuel/air mixtures can cause a pressure spike, which may damage certain piston engines and which can cause excessive vibration. Diluted, lean mixtures, which minimize these problems, can be achieved by (1) using a high air/fuel ratio or (2) exhaust gas recycling (ERG). Unfortunately, a high air/fuel ratio results in significant unburned hydrocarbon emissions and ERG management can be technically complex. In principle, SCCI can address both the pressure spike and unburned hydrocarbon emissions issues. With SCCI, only the charge in the mixing/combustion chamber is a combined fuel/air charge; the charge remaining in the unswept volume of the expansion chamber is comprised primarily of air.

The inventor believes that an SCCI near-stoichiometric fuel/air charge in the mixing/combustion chamber will have the rapid combustion characteristic associated with HCCI (thereby minimizing the emission of oxides of nitrogen because of the rapidity of combustion) and the lower, in-cylinder pressures associated with lean fuel/air mixtures (thereby mitigating pressure shock). SCCI further results in a high combustion temperature locally in the mixing/combustion chamber that minimizes unburned hydrocarbon emissions. As is the case with other stratified charge engines, carbon monoxide emissions may also be mitigated as product carbon monoxide from the combustion event reacts with the excess air in the expansion chamber. It should further be noted that, as Van Blarigan has shown, with free-piston (as opposed to piston/crankshaft) engines, the precise timing of the combustion event is not extremely critical. The HCCI or SCCI free-piston engine should operate efficiently even with some overcompression of the fuel/air charge.

While HCCI and SCCI engines generally have several inherent benefits as replacements for spark ignition and diesel engines in vehicles with conventional powertrains, they are particularly well suited for use in internal combustion engine/electric series hybrid vehicles. In these hybrids, engines can be optimized for operation over a tightly limited range of speeds and loads, thus eliminating many of the control issues normally associated with HCCI or SCCI and creating a highly fuel-efficient vehicle. Among other applications, the present method would allow the strengths of an SCCI combustion engine to be combined with the advantages of a rotary free-piston engine in an electric series hybrid powertrain.

Therefore, the teaching of the present method is that the linear motion of a free-piston can be converted, in part, to rotational motion by means of helical channels provided on the surfaces of the compression heads in the engine's air boxes, which serve to impart torque to the free-piston during the course of the free-piston's reciprocating motion. By placing the load 31 (e.g., magnets or coils) on the exterior surface of the mounting piston section 8 the weight of the load 31 serves to preserve the angular momentum supplied by the torque. In this manner, the rotational velocity of the load relative to the stator can exceed the linear velocity of a reciprocating-only free-piston relative to the stator, which is beneficial for free-piston generator or motor/generator electrical power generation. Moreover, the method can be employed with materials that are poor thermal conductors and in an oilless condition, as described above. The method further allows for different ignition regimes to be employed such as diesel ignition, spark ignition or SCCI.

Since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes, which come within the meaning and range of equivalency of the claims, are intended to be embraced therein.

What is claimed is:

1. A method for converting free-piston linear motion into rotary motion, comprising:

providing a free-piston generator or motor/generator that includes at least one piston having two compression heads; and, for each piston, a surface is provided on each compression head defining a helical channel, wherein the piston is rotated in a single direction due to the force imparted to the piston as compressed air in an air box is forced through the helical channel.

2. The method of claim 1, wherein the movement of the compressed air, and its associated boundary layer molecular drag, through the helical channels converts linear motion of the one or more pistons to rotary motion.

3. The method of claim 1, wherein the generator is free from a receiver, separate gas turbine, push-pull bearing and vanes.

4. The method of claim 1, wherein the reciprocal motion of the piston, a portion of which is converted to rotary motion, is initiated by diesel ignition of fuel and an oxidizer such as air.

5. The method of claim 1 wherein the reciprocal motion of the piston, a portion of which is converted to rotary motion, is initiated by spark ignition of fuel and an oxidizer such as air.

6. The method of claim 1 wherein the reciprocal motion of the piston, a portion of which is converted to rotary motion, is initiated by stratified charge compression ignition of fuel and an oxidizer such as air.

* * * * *